US006119444A

United States Patent [19]

Sostegni

[11] Patent Number: 6,119,444

[45] Date of Patent: Sep. 19, 2000

[54] APPARATUS FOR THE FORMATION OF YARN IN A CHENILLE MACHINE

[75] Inventor: Giuliano Sostegni, Sesto Fiorentino, Italy

[73] Assignee: Giesse S.R.L., Italy

[21] Appl. No.: 09/102,286

[22] Filed: Jun. 22, 1998

[30] Foreign Application Priority Data

Jul. 2, 1997 [IT] Italy ..... FI97A155

[51] Int. Cl.[7] ..... D02G 3/42

[52] U.S. Cl. ..... 57/24; 57/203

[58] Field of Search ..... 57/24, 908, 28, 57/30, 203; 28/144

[56] References Cited

U.S. PATENT DOCUMENTS

| | | | |
|---|---|---|---|
| 3,645,078 | 2/1972 | Roberts | 57/24 |
| 3,861,128 | 1/1975 | Whitaker | 57/24 |
| 3,929,268 | 12/1975 | Gross | 226/176 |
| 3,969,881 | 7/1976 | Boldrini | 57/24 |
| 4,288,973 | 9/1981 | Tani | 57/24 |
| 5,651,168 | 7/1997 | Tung et al. | 28/220 |

FOREIGN PATENT DOCUMENTS

| | | | |
|---|---|---|---|
| 46-25538 | 7/1971 | Germany | 57/24 |
| 3106810 | 9/1982 | Germany | 57/24 |
| 3038096 | 10/1990 | Germany | 28/144 |
| 59-173332 | 10/1984 | Japan | 57/24 |

*Primary Examiner*—William Stryjewski
*Attorney, Agent, or Firm*—McGlew and Tuttle, P.C.

[57] ABSTRACT

Apparatus for driving interweaving threads in a yarn-forming unit of a chenille machine comprising, for each of the two sides of a gauge (1) on which the fuzzy thread is wound and sized, a pair of rollers (3, 30) forming a calender for driving two interweaving threads to be twisted in order to engage the lengths of the fuzzy thread. Of the rollers (3, 30), the upper one (3) of at least one of the two pairs is provided with a plurality of radial channels (31) associated to air-suction device to pull in the lengths of fuzzy threads being cut by a blade (2) towards the respective edge, at least over an arc thereof instantaneously facing the gauge (1) during the rotation of the rollers (3, 30) of the pair.

8 Claims, 3 Drawing Sheets

APPARATUS FOR THE FORMATION OF YARN IN A CHENILLE MACHINE

FIELD OF THE INVENTION

The present invention refers to an apparatus for the formation of yarn in a chenille machine. A yarn chenille is known to be made up of two suitably twisted interweaving threads intended to engage lengths of a fuzzy thread. To this purpose, the chanille machines comprise at least a yarn-forming unit in which a gauge is provided for winding up and sizing the fuzzy thread, a circular blade for cutting this fuzzy thread into lengths of predetermined extension, means for moving forward the threads together with the lenghts of fuzzy thread by a pair of rollers or wheels forming, on both sides of the gauge, a calender member for driving the interweaving threads, and means for twisting the interweaving threads with the lengths of fuzzy threads interposed therebetween. The yarn thus produced takes up a typical, substantially cylindrical configuration with a central core consisting of twisted interweaving threads and from which the free ends of the lengths of fuzzy thread are made to protrude.

BACKGROUND OF THE INVENTION

One of the problems mostly felt also in this industrial field is how to increase the production in a simple and cost-effective way without impairing the quality of the finished product.

SUMMARY AND OBJECTS OF THE INVENTION

The main object of the present invention is to overcome the above problem.

A further object of the present invention is that of improving the quality of the finished product.

According to the invention, an apparatus for driving interweaving threads in a yarn-forming unit of a chenille machine is provided. The apparatus has a gauge on which fuzzy thread is cut into lengths of predetermined extension by a circular blade located in front of the gauge. The fuzzy thread is wound and seized on the gauge. A pair of rollers is disposed at a short and preset distance from the gauge. The pair of rollers forms a calendar which drives into motion the two threads to be twisted in order to engage the lengths of the fuzzy thread. The axis of rotation of the rollers is parallel to each other and to the plane of the blade. The edges on which the draw takes place are orthogonal to the gauge. The upper pair of the two pairs of rollers is provided with rollers having a plurality of radial channels. The radial channels are connected to an air-suction device to pull in the lengths of fuzzy thread which are cut by the blade and to position this at or adjacent to the respective edge, at least over an arc thereof which is at that time facing the gauge, during the rotation of the rollers of the pair.

The advantages deriving from the present invention lie essentially in that it is possible to increase the production as well as the quality of the chenille yarn in a simple and cost-effective way without major interventions for structural changes in the chenille-forming machines already in existence; that it is possible to simplify the guide of at least part of the interweaving threads as well as the conformation of the gauge, the latter exhibiting a slit in the conventional systems to guide the interweaving threads which rest onto the lower rollers of the driving calenders disposed by the sides of the gauge, by fully eliminating the need of providing such slit in the body of the gauge and thus lowering both cost and time for the manufacturing thereof; that an apparatus according to the invention is simple to make, cost-effective and reliable even also a prolonged service life.

These and other advantages and characteristics of the invention will be best understood by anyone skilled in the art from a reading of the following description in conjunction with the attached drawings given as a practical exemplification of the invention, but not to be considered in a limitative sense, wherein:

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1A:
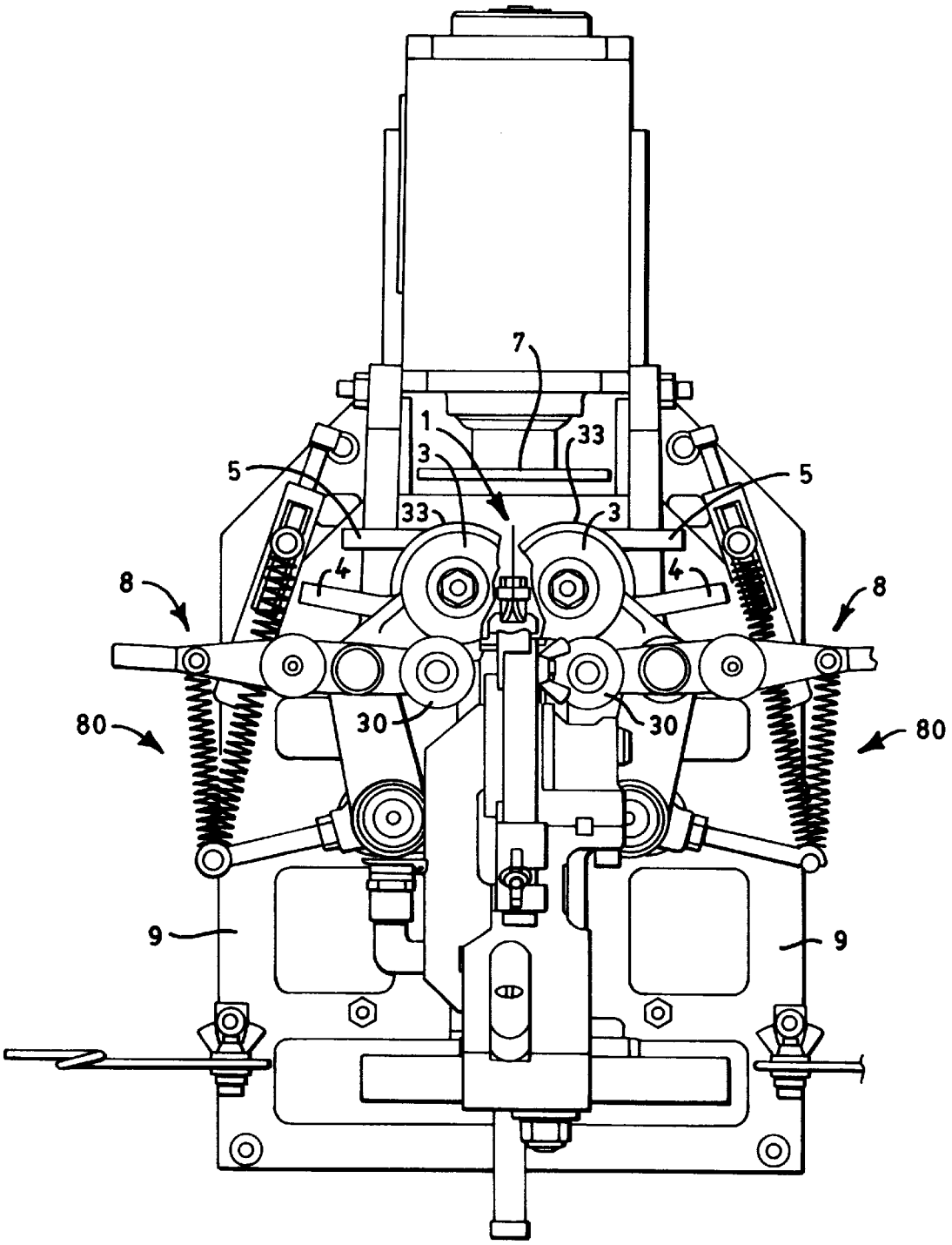
FIG. 1A shows a front view of an apparatus according to the invention in a yarn-forming unit for chenille machines.

Reduced to its basic structure, and reference being made to the figures of the attached drawings, an apparatus for driving interweaving threads in a yarn-forming unit of a chenille machine according to the invention comprises, for each of the two sides of the gauge (1) on which the fuzzy thread to be cut into lenghts of predetermined extension by a circular blade (2) located in front of the gauge (1)—is wound and sized, a pair of rollers (3, 30) disposed at a short and preset distance from the gauge (1) and forming a calender which drives into motion the two threads to be twisted in order to engage the lengths of fuzzy thread, the axis of rotation of the rollers (3, 30) being parallel to each other and to the plane of the blade (2), so that the respective edges on which the very draw takes place will result orthogonal to the gauge (1). Of the rollers (3, 30), the upper one (3) of at least one of the two pairs is provided with a plurality of radial channels (31) associated to air-suction means to pull in the lengths of fuzzy threads being cut by the blade (2) towards the respective edge at least over an arc thereof instantaneously facing the gauge (1) during the rotation of the rollers (3, 30) of said pair.

Guided on the edge of the first roller (3) is a corresponding interweaving thread which is directed towards the edge of the second roller (30) together with the lengths of the fuzzy thread being removed from the surface of the gauge (1) by means of the suction. Also guided on the edge of the second roller (30) is the second interweaving thread and, owing to the twisting of the two interweaving threads with the lengths of fuzzy thread interposed therebetween, the chenille yarn is produced. The twisting of the two interweaving threads is operated in a conventional way, that is, by winding up the threads on a spindle driven into rotation at a preset speed by a driving member. The transfer of the lengths of fuzzy thread from the gauge (1) to the roller (30), in the manner described above, is particularly effective, also under heavy operating conditions, contrary to the case of conventional systems which not always ensure the proper transfer of the lengths of fuzzy thread from the gauge to the draw rollers. Since the removal of the lengths of fuzzy thread is operated directly by the roller (3), there is no need for passing the interweaving threads through the body of the gauge, contrary to the case of conventional systems.

Advantageously, in order to improve the suction effect over the active edge of the roller (3), a side surface thereof is provided with holes (32) which in the whole make up an air intake of suitable dimensions.

Advantageously, according to the invention, the above channels (31) of the roller (3) are further associated to air ejection means to obtain the ejection of the lengths of fuzzy thread possibly retained inside the channels (31), that is, those not engaged by the interweaving threads, so that the channels (31) will as a result always be free to allow for the intervention of the suction means (4).

Moreover, advantageously, the body of the roller (3) is housed in a cap (33) to which the air suction and ejection means are connected by means of corresponding fixed conduits (4, 5). Suitably provided rearwardly of the roller (3) is a distributor (6) with a plurality of slots (60) to which the conduits (4, 5) communicating with the channels (31) are connected.

The advantages derived from the use of the above described apparatus are obtainable, though to a less appreciable extent, also in the case in which only one of the rollers (3) sideway of the gauge (1) is shaped as indicated above.

Figure 1B:
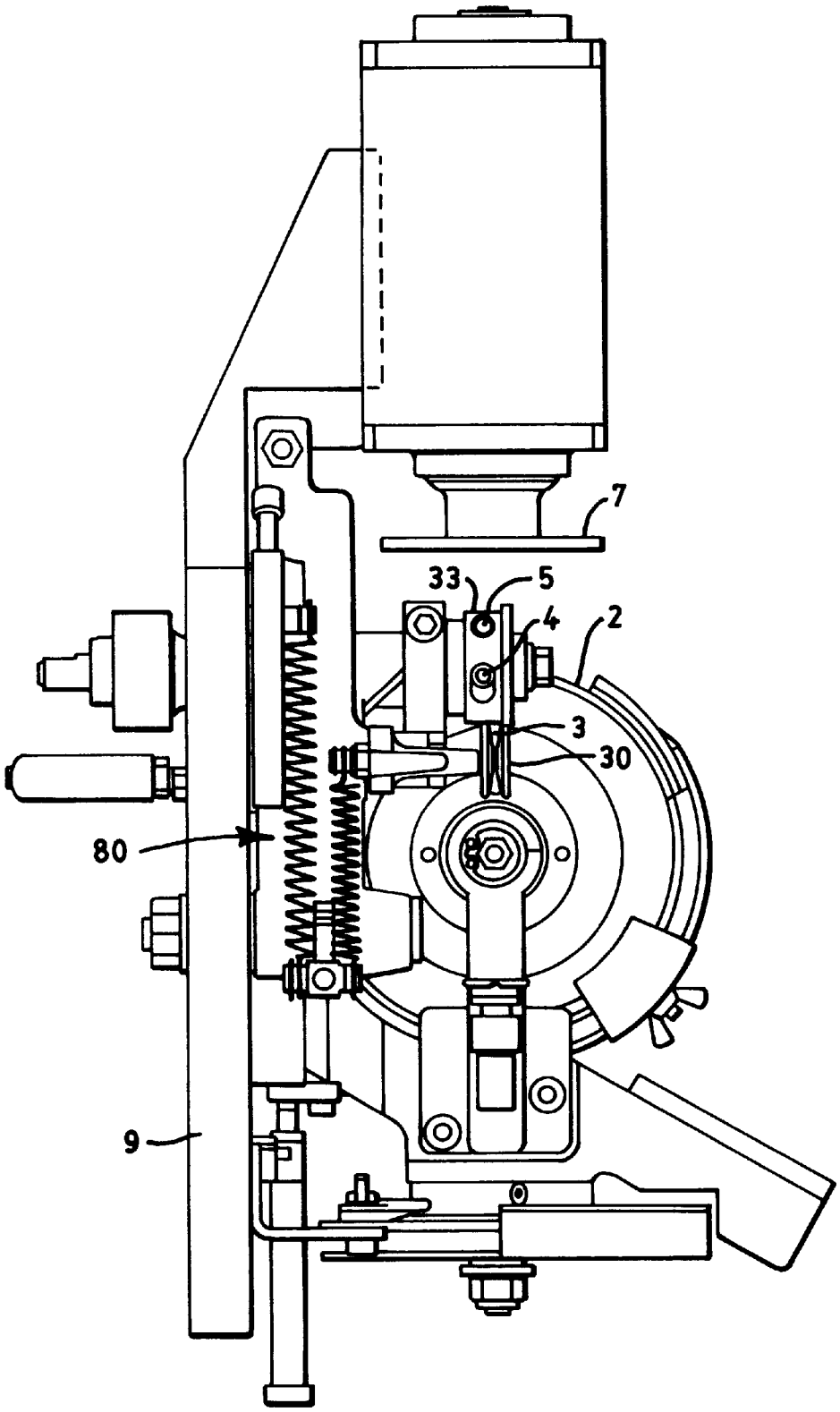
FIG. 1B shows a side view of the unit with the apparatus of FIG. 1A.
Figure 2A:
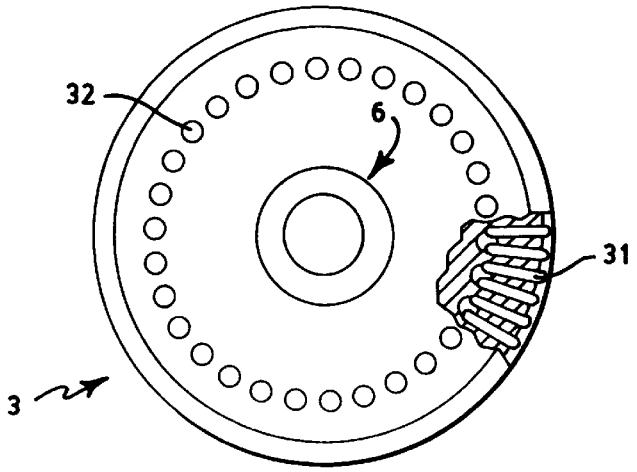
FIG. 2A shows the front view, partially in section, of the upper roller of the apparatus according to the invention.
Figure 2B:
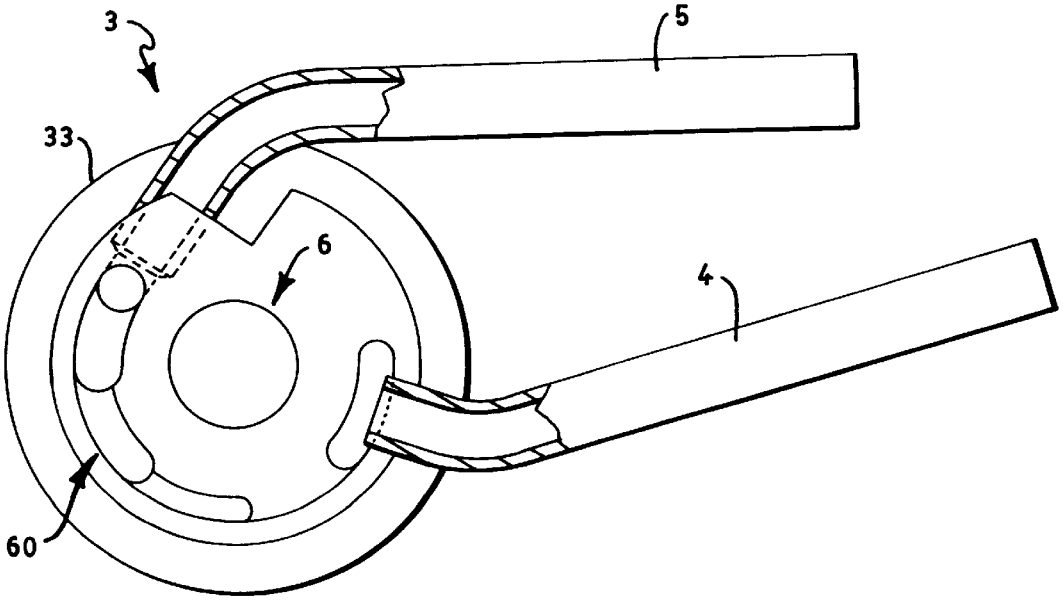
FIG. 2B shows a view, partially in section, of means for the suction and ejection of air through the radial channels of the roller of FIG. 2A.

FIGS. 1A and 1B of the accompanying drawings show the head (7) for winding up the fuzzy thread over the gauge (1) and the movable arms (8) for supporting the rollers (3, 30). The arms (8) are connected to the machine frame (9) and associated to springs (80) for bringing the rollers (3, 30) back to the gauge (1).

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. An apparatus for driving interweaving threads in a yarn-forming unit of a chenille machine, the apparatus comprising:

a gauge with fuzzy thread wound thereon;

a circular blade for cutting the fuzzy thread into lengths of predetermined extension, said circular blade being located in front of said gauge;

an upper roller disposed at a short and preset distance from said gauge;

a lower roller disposed at a short and preset distance from said gauge, said upper roller and said lower roller cooperating to form a calender which drives into motion two threads to be twisted in order to engage lengths of fuzzy thread, the axis of rotation of said pair of rollers being parallel and being parallel to a plane of said circular blade whereby the periphery of said rollers is orthogonal to said gauge, said upper roller having a plurality of radial channels;

an air-suction device to apply suction to said upper roller in communication with some of said radial channels, over an arc region corresponding to radial channels in an arc region of said periphery of said upper roller, which faces the gauge during the rotation of the rollers, whereby said suction pulls in the lengths of fuzzy threads being cut by the blade towards said arc region of said periphery to be engaged by the two threads.

2. The apparatus according to claim 1, wherein one side surface of said upper roller is provided with holes each hole of said holes connecting to a respective one of said radial channels to provide an air intake of suitable dimensions.

3. The apparatus according to claim 1, further comprising:

an air ejection device providing air under pressure to apply air to said upper roller in communication with some of said radial channels, over another arc region corresponding to radial channels in another arc region of said periphery of said upper roller, to eject lengths of fuzzy thread possibly retained inside said channels and not engaged by the interweaving threads so that said channels are free for the application of suction by said suction device.

4. The apparatus according to claim 3, a body of said upper roller is housed in a cap and wherein said suction device has a suction conduit connected to said cap and said ejection device has an ejection conduit connected to said cap.

5. The apparatus according to claim 1, further comprising a distributor located rearwardly of said upper roller and having a plurality of slots wherein said suction device has a suction conduit connected to said distributor and said ejection device has an ejection conduit connected to said distributor.

6. An apparatus for driving interweaving threads in a yarn-forming unit of a chenille machine, the apparatus comprising:

a gauge with fuzzy thread wound thereon for paying out size lengths of fuzzy thread;

a circular blade for cutting the fuzzy thread into the lengths of predetermined extension, said circular blade being located in front of said gauge;

an upper roller disposed at a short and preset distance from said gauge;

a lower roller disposed at a short and preset distance from said gauge, said upper roller and said lower roller cooperating to form a calender which drives into motion two threads to be twisted in order to engage the lengths of fuzzy thread, the axis of rotation of said pair of rollers being substantially parallel and being substantially parallel to a plane of said circular blade whereby a periphery of said rollers is substantially orthogonal to said gauge, said upper roller having a plurality of radial channels and one side surface of said upper roller is provided with holes each hole of said holes connecting to a respective one of said radial channels to provide an air intake for each of said radial channels;

a distributor positioned adjacent to said upper roller and having a slot which registers with a plurality of air intakes;

an air-suction device with a conduit connected to said slot of said distributor, said suction device applying suction to said plurality of air intakes in registration with said slot of said distributor to provide suction to some of said radial channels, in an arc region of said periphery of said upper roller, which faces the gauge during the rotation of the rollers, whereby said suction pulls in the lengths of fuzzy threads being cut by the blade towards said arc region of said periphery to be engaged by the two threads.

7. The apparatus according to claim 6, further comprising:

an air ejection device providing air under pressure to apply air to said upper roller in communication with some of said radial channels, over another arc region corresponding to radial channels in another arc region of said periphery of said upper roller to eject lengths of fuzzy thread possibly retained inside said channels and not engaged by the interweaving threads so that said channels are free for the application of suction by said suction device.

8. The apparatus according to claim 7, a body of said upper roller is housed in a cap and wherein said suction device has a suction conduit connected to said cap and said ejection device has an ejection conduit connected to said cap.

* * * * *